US005996260A

United States Patent [19]

MacNeill

[11] Patent Number: 5,996,260

[45] Date of Patent: Dec. 7, 1999

[54] DUAL DENSITY PLASTIC CLEAT FOR FOOTWEAR

[75] Inventor: Harris L. MacNeill, Northborough, Mass.

[73] Assignee: MacNeill Engineering Company, Inc., Marlborough, Mass.

[21] Appl. No.: 09/178,988

[22] Filed: Oct. 26, 1998

[51] Int. Cl.[6] ..... A43B 5/00; A43C 15/00

[52] U.S. Cl. ..... 36/134; 36/67 D

[58] Field of Search ..... 36/67 R, 67 D, 36/134

[56] References Cited

U.S. PATENT DOCUMENTS

| | | | |
|---|---|---|---|
| 4,466,205 | 8/1984 | Corbari | 36/134 |
| 4,648,187 | 3/1987 | Dassler et al. | 36/67 D |
| 4,712,318 | 12/1987 | Greiner et al. | 36/134 |

FOREIGN PATENT DOCUMENTS

| | | | |
|---|---|---|---|
| 524861 | 1/1993 | European Pat. Off. | 36/134 |
| 3811513 | 10/1989 | Germany | 36/134 |
| 3915157 | 11/1989 | Germany | 36/134 |
| 2098457 | 11/1982 | United Kingdom | 36/134 |
| 2257616 | 1/1993 | United Kingdom | 36/134 |

*Primary Examiner*—M. D. Patterson

*Attorney, Agent, or Firm*—Bromberg & Sunstein LLP

[57] ABSTRACT

The invention relates to a removably attachable cleat for shoes, and in particular, to a removable athletic shoe cleat. The cleat has a base of a strong material and an outer layer of a soft material which absorbs some of the impact force when the cleat strikes a surface. Giving the base material and the outer layer material distinctively different visual appearance also provides clear indication to a user of when the outer layer has worn away and the cleat should be replaced.

6 Claims, 2 Drawing Sheets

DUAL DENSITY PLASTIC CLEAT FOR FOOTWEAR

FIELD OF THE INVENTION

This invention relates to the mounting of traction gear on the bottom of footwear, in particular, athletic footwear.

BACKGROUND ART

An athletic cleat is intended to engage the athletic surface so as to resist excessive slipping of the athletic shoe. Thus, the cleat must be constructed of a material stiff enough to withstand the substantial forces attendant upon such non-slipping engagement. However, such cleat materials are also relatively rigid. As a result, the impact of the cleat striking the athletic surface is transmitted without significant diminution to the athletic shoe and the foot encased therein. Over a prolonged period, a wearer becomes uncomfortable and fatigued. This problem is particularly significant on hard surfaces which the cleat does penetrate. Unfortunately, softer cleat materials which better absorb and dissipate the striking impact are not stiff enough to properly engage the athletic surface without slipping. No single cleat material offers an ideal combination of strength and shock-absorption.

SUMMARY

The present invention provides a removable cleat for footwear. A preferred embodiment has an internal support structure made of a first material—e.g., metal—with a vertical axis and upper and lower ends. At the upper end there is attachment means for removably attaching the cleat to the footwear. A base made of a second material—e.g., nylon, acetal, hard polyurethane, or hard plastic—is connected to the internal support structure. A ground-traction outer layer made of a third material softer than the second material—e.g., natural rubber, thermoplastic rubber, soft polyvinyl-chloride, or soft plastic—is substantially supported by the base. The second material may be chosen to be relatively hard so as to contribute strength and stability to the overall cleat structure. The third material may be chosen to be relatively soft so as to resiliently absorb some of the impact force of the cleat engaging the ground.

In a further embodiment, the base has a first characteristic appearance and the outer layer has a second characteristic appearance different from the first characteristic appearance. Such characteristic appearances may be, for example, distinctive colors, or the outer layer may be translucent. In such an embodiment, the base becomes externally observable as the outer layer wears away so as to indicate a need to replace the cleat.

In some embodiments, the cleat may be designed so that a portion of the base—e.g., a centered disc—is normally visible when the cleat is attached to the footwear. As the outer layer wears away, the portion of the base which is externally visible increases in size. Alternatively, or in addition, in an embodiment the cleat may further include a plurality of projections that may or may not substantially penetrate an athletic turf. These projections may be circumferentially disposed around the base a radial distance out from the vertical axis.

Another preferred embodiment is a removable cleat for footwear which has attachment means to removably attach the cleat to the footwear, and a ground traction member connected to the attachment means. The ground traction member has an inner layer of a first material with a first visual appearance, and an outer layer of a second material with a second visual appearance different from that of the inner layer such that as the outer layer wears away, the inner layer becomes externally visible.

In such an embodiment, the first material may nylon, acetal, hard polyurethane, or hard plastic. The second material may be natural rubber, thermoplastic rubber, soft polyvinyl-chloride, soft polyurethane, or soft plastic. The second material may also be translucent, or have a solid color. In such an embodiment, the second material may be softer than the first material. The first visual appearance may be a first distinctive color and the second visual appearance may be a second distinctive color. In addition, a portion of the inner layer may be externally visible—e.g., a centered disc—when the cleat is attached to the footwear such that as the outer layer wears away, the portion of the inner layer which is externally visible increases in size. Such an embodiment may also include a plurality of projections for contact with an athletic turf, for example, the base may have an outer circumference and the projections may be disposed around the outer circumference.

Another preferred embodiment is also a removable cleat for footwear. Such an embodiment includes attachment means to removably attach the cleat to the footwear, and a ground traction member connected to the attachment means. The ground traction member has a harder first material which contributes strength and stability to the member, and a softer second material which resiliently absorbs force when the ground traction member contacts the ground.

In such an embodiment, the first material may be nylon, acetal, hard polyurethane, or hard plastic. The second material may be natural rubber, thermoplastic rubber, soft polyvinyl-chloride, soft polyurethane, or soft plastic. The first material may have a first characteristic appearance and the second material may have a second characteristic appearance different from the first characteristic appearance. The first characteristic appearance may be a first distinctive color and the second characteristic appearance may be a second distinctive color. In such an embodiment, as the second material wears away, the first material becomes externally visible.

In addition, portions of the first material and the second material may be externally visible when the cleat is attached to the footwear. For example, the externally visible portion of the first material may be a centered disc. In such a case, as the second material wears away, the externally visible portion of the first material increases in size. The cleat may further include a plurality of projections for contact with an athletic turf, and the base may have an outer circumference and the plurality of projections may be disposed around the outer circumference.

BRIEF DESCRIPTION OF THE DRAWINGS

The following drawings are intended to provide a better understanding of the present invention, but they are in no way intended to limit the scope of the invention.

DETAILED DESCRIPTION OF PREFERRED EMBODIMENTS

Figure 1:
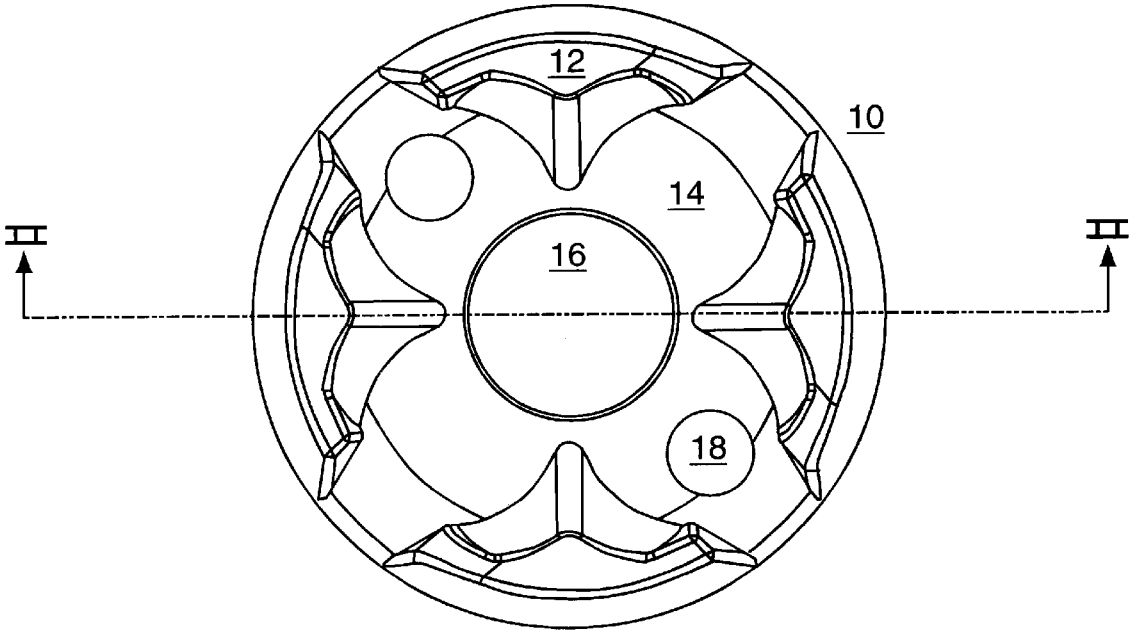
FIG. 1 is a bottom view, i.e., as seen from the ground, of a dual density cleat according to a preferred embodiment of the present invention.
Figure 2:
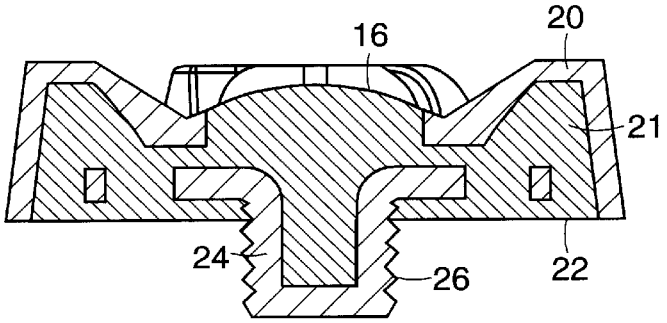
FIG. 2 is a side cross-sectional view of the cleat of FIG. 1.
Figure 3:
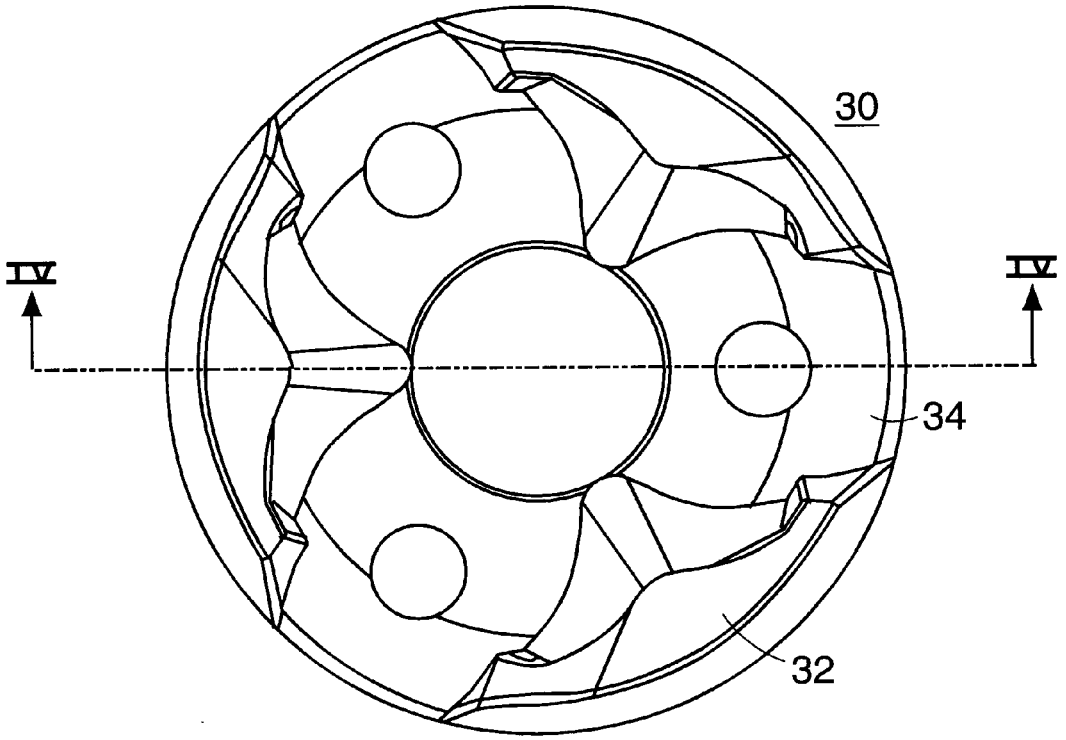
FIG. 3 is a bottom view, i.e., as seen from the ground, of a dual density cleat according to another embodiment of the invention.

FIG. 1 illustrates a dual density cleat according to a preferred embodiment of the present invention. In this case, the cleat 10 has a four-lobe ground-engaging member of the modern type of golf cleat. Around the outer circumference are four projections 12 which protrude out from a foundation 14. FIG. 3 illustrates an alternative cleat 30 having a three lobe traction engaging member comprising three projections 32 which protrude out from a foundation 34.

Figure 4:
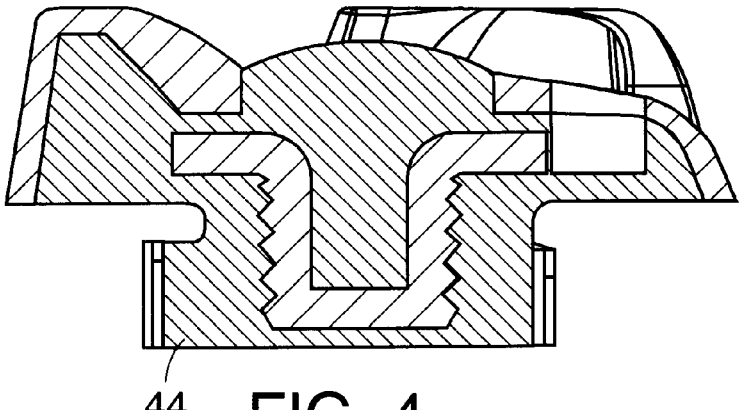
FIG. 4 is a side cross-sectional view of the cleat of FIG. 3.

As seen from the ground, the overall shape of the cleat, 10 of FIG. 1, is circular. The top of the cleat is substantially flat so as to form a skirt 22 which contacts the sole of the athletic shoe when the cleat is installed. A preferred embodiment further includes an internal metal support structure 24, a portion of which may project above the skirt 22 to form attachment means for connecting the cleat 10 to a shoe. In FIG. 1, the internal metal support structure 24 is shown as having threads 26 adapted to engage a threaded receptacle in the sole of the shoe. Alternatively, as shown in FIG. 4, the attachment means may take the form of a proprietary connector 44 such as used in the MacNeill Engineering Q-lok™ System (described in U.S. Pat. No. 5,768,809, issued Jun. 23, 1998, which is incorporated herein by reference).

When the cleat 10 is attached to an athletic shoe descending towards the turf, the projections 12 are the first part of the cleat 10 to engage the ground. In order to cushion the impact, the projections 12 are covered with an outer layer 20 of relatively soft deformable material, such as natural rubber, thermoplastic rubber, soft polyvinyl-chloride, soft poly urethane, or soft plastic. The density and abrasion resistance of this soft deformable material of the outer layer 20 may be controlled to vary the amount of wear or durability of the cleat 10. The outer layer 20 of soft deformable material overlays the projections 12 and is supported by stronger and stiffer material of the base 21, e.g., nylon, acetal, hard polyurethane, or hard plastic. The soft outer layer 20 also provides improved traction or slip resistance in environments other than turf penetrating athletic surfaces such as on smooth or slick surfaces, e.g., tile floors.

The material of the base 21 is also visible in the central core area 16 of the cleat. The core area 16 does not protrude out from the foundation 14 as much as the projections 12. Consequently, the central core 16 does not engage the ground until after the outer layer 20 of softer material which overlays the projections 12 has absorbed and dissipated some of the striking impact force. However, because of the strength and stiffness of the material of the base 21 at the central core 16 and underlying the projections 12, the material of the base 21 provides the support needed to properly engage the athletic shoe with the athletic surface. In addition, the material of the base 21 surrounds and increases the strength and durability of wrench holes 18 in the cleat 10 which are used by a cleat wrench to install and remove the cleat 10 from the shoe.

Additional advantage may be realized by having the soft deformable material of the outer layer 20 and the stiff inner material of the base 21 use contrasting colors. A user observing the appearance of such a cleat 10 will note a uniform cleat color due to the outer layer 20, except for the contrasting color of the stiff inner material of the base 21 appearing at the center core 16 which is suggestive of a bull's eye. Over a period of use, the soft deformable material of the outer layer 20 wears down and the contrasting color of the center core 16 bull's eye, which indicates the stiff material of the base 21, emerges from the area of the projections 12. Thus, a user has an easily observable positive indication of when the soft outer layer has worn away sufficiently that the cleat 10 requires replacement.

Rather than using contrasting colors, the same observation of cleat wear may be achieved when the soft deformable material of the outer layer 20 and the stiff inner material of the base 21 are similarly colored, but the outer layer 20 is semi-transparent or translucent. In such case, a user looking at the cleat 10 can directly observe the amount of soft deformable material of the outer layer 20 which remains over the projections 12, and the worn cleat 10 may be replaced before the outer layer 20 has worn away to the point that the the stiff inner material of the base 21 emerges through the projections 12.

In the preceding description, and in the following claims, the term "cleat" is consistently used, however, no distinction is intended to be created between cleats and spikes, nor should any such distinction be inferred.

What is claimed is:

1. A removable cleat for footwear comprising:

an internal support structure having upper and lower ends, the support structure being made of a first material;

attachment means at the upper end of the internal support structure for removably attaching the cleat to the footwear;

a base connected to the lower end of the internal support structure, the base having an outer circumference around which is disposed a plurality of projections, the base being made of a second material having a first visual appearance; and an outer layer substantially supported by the base, the outer layer being made of a third material having a second visual appearance different from that of the base and which is softer than the second material, wherein a centered disc portion of the base without projections is externally visible and visually contrasts with the outer layer.

2. A removable cleat as in claim 1, wherein the first material is metal.

3. A removable cleat as in claim 1, wherein the second material is nylon, acetal, hard polyurethane, or hard plastic.

4. A removable cleat as in claim 1, wherein the third material is natural rubber, thermoplastic rubber, soft polyvinyl-chloride, soft polyurethane, or soft plastic.

5. A removable cleat as in claim 1, wherein the third material is translucent.

6. A removable cleat as in claim 1, wherein the first visual appearance is a first distinctive color and the second visual appearance is a second distinctive color.

* * * * *